US012654053B2

(12) United States Patent
Ivanov

(10) Patent No.: US 12,654,053 B2
(45) Date of Patent: Jun. 16, 2026

(54) MAT SYSTEM

(71) Applicant: Suples, Ltd., Boise, ID (US)

(72) Inventor: Ivan Ivanov, Boise, ID (US)

(73) Assignee: Suples, Ltd., Boise, ID (US)

( * ) Notice: Subject to any disclaimer, the term of this patent is extended or adjusted under 35 U.S.C. 154(b) by 308 days.

(21) Appl. No.: 17/655,374

(22) Filed: Mar. 18, 2022

(65) Prior Publication Data

US 2022/0314051 A1 Oct. 6, 2022

Related U.S. Application Data

(60) Provisional application No. 63/171,325, filed on Apr. 6, 2021.

(51) Int. Cl.
*A63B 6/00* (2006.01)

(52) U.S. Cl.
CPC ..... *A63B 6/00* (2013.01); *A63B 2209/10* (2013.01); *A63B 2210/50* (2013.01); *A63B 2244/108* (2013.01)

(58) Field of Classification Search
CPC ..... A63C 19/04; A63C 19/02; A63C 19/005; A63C 19/00; A63C 19/12; A47D 13/063; A47D 13/061; A47D 13/06; A47D 13/066; A63B 2209/10; A63B 2210/50; A63B 21/4037; A63B 69/00; A63B 6/00–025; A63B 2244/10–108; A47G 27/0237; A47G 27/0293
See application file for complete search history.

(56) References Cited

U.S. PATENT DOCUMENTS 3,319,273 A * 5/1967 Solin ..... A63B 6/00 473/29
3,711,349 A * 1/1973 Snyder ..... A47G 27/045 156/289
5,173,346 A * 12/1992 Middleton ..... B32B 5/18 4/581
5,904,021 A 5/1999 Fisher
(Continued)

FOREIGN PATENT DOCUMENTS

CN 101553286 A 10/2009
CN 211513254 U 9/2020
(Continued)

OTHER PUBLICATIONS

Translation of KR-20150098003-A (Year: 2015).*
(Continued)

*Primary Examiner* — Loan B Jimenez
*Assistant Examiner* — Catrina A Letterman
(74) *Attorney, Agent, or Firm* — Schwegman, Lundberg & Woessner, P.A.

(57) ABSTRACT

A mat system may include a plurality of mats. Each of the plurality of mats may include a first surface, a second surface, and a curved surface. The first surface may include a first connector and the second surface may include a second connector. The curved surface may extend from the first surface to the second surface. Upon assembly of the mat system, the first and second connectors of a mat may engage connectors of a first and second adjacent mats. The curved surfaces of the plurality of mats may form a void in a center region of the mat system.

13 Claims, 5 Drawing Sheets

(56) References Cited

U.S. PATENT DOCUMENTS

| | | | | | |
|---|---|---|---|---|---|
| 5,970,541 | A * | 10/1999 | Chiang | A47D 11/00 | 5/420 |
| 6,083,596 | A * | 7/2000 | Pacione | A47G 27/045 | 156/304.3 |
| 6,408,463 | B1 * | 6/2002 | Palacio | A47D 15/003 | 5/655 |
| 6,443,794 | B2 * | 9/2002 | Oren | A63H 33/00 | 446/85 |
| 7,494,445 | B1 * | 2/2009 | Chen | A63B 5/11 | 482/35 |
| 8,071,186 | B1 * | 12/2011 | Quimby | E04F 15/107 | 52/177 |
| 8,266,857 | B2 | 9/2012 | David | | |
| 9,259,611 | B2 | 2/2016 | Abel et al. | | |
| 2001/0017017 | A1 | 8/2001 | Pacione | | |
| 2010/0323862 | A1 * | 12/2010 | Sohn | A63B 21/4037 | 482/145 |

FOREIGN PATENT DOCUMENTS

| | | | | | |
|---|---|---|---|---|---|
| CN | 115192959 | A | | 10/2022 | |
| DE | 2040543 | | | 2/1972 | |
| DE | 29519784 | | | 2/1996 | |
| EP | 4070693 | | | 7/2025 | |
| GB | 2101885 | | | 1/1983 | |
| GB | 2101885 | A | * | 1/1983 | A47G 27/0212 |
| JP | S51131357 | | | 11/1976 | |
| JP | S61185350 | | | 11/1986 | |
| JP | H054976 | U | * | 1/1993 | A47G 27/02 |
| JP | 2007054605 | | | 3/2007 | |
| KR | 20150098003 | A | * | 8/2015 | A63F 11/00 |
| KR | 20160138650 | A | * | 12/2016 | A47D 13/06 |
| WO | WO-2011090499 | A1 | | 7/2011 | |

OTHER PUBLICATIONS

Translation of JPH054976U (Year: 1993).*
Translation of KR-20160138650 (Year: 2016).*
"European Application Serial No. 22163095.7, Extended European Search Report mailed Aug. 4, 2022", 8 pgs.
"Chinese Application Serial No. 202210287833.5, Office Action mailed Jan. 30, 2024", w/ English Translation, 21 pgs.
"European Application Serial No. 22163095.7, Communication Pursuant to Article 94(3) EPC mailed Sep. 27, 2023", 6 pgs.
"European Application Serial No. 22163095.7, Response filed Jan. 23, 2024 to Communication Pursuant to Article 94(3) EPC mailed Sep. 27, 2023", 10 pgs.
"Indian Application Serial No. 202214015561, First Examination Report mailed Oct. 20, 2022", 7 pgs.
"Indian Application Serial No. 202214015561, Hearing Notice mailed Mar. 4, 2024", 2 pgs.
"Indian Application Serial No. 202214015561, Response filed Feb. 22, 2023 to First Examination Report mailed Oct. 20, 2022", w/ English claims, 25 pgs.
"European Application Serial No. 22163095.7, Communication Pursuant to Article 94(3) EPC mailed May 17, 2024", 6 pgs.
"Chinese Application Serial No. 202210287833.5, Response filed May 30, 2024 to Office Action mailed Jan. 30, 2024", w current English claims, 14 pgs.
"Chinese Application Serial No. 202210287833.5, Office Action mailed Jul. 16, 2024", w English translation, 14 pgs.
"Chinese Application Serial No. 202210287833.5, Response filed Sep. 14, 2024 to Office Action mailed Jul. 16, 2024", w current English claims, 16 pgs.
"Chinese Application Serial No. 202210287833.5, Decision of Rejection mailed Dec. 17, 2024", w English translation, 15 pgs.
"European Application Serial No. 22163095.7, Response filed Nov. 12, 2024 to Communication Pursuant to Article 94(3) EPC mailed May 17, 2024", w claims, 5 pgs.

* cited by examiner

MAT SYSTEM

PRIORITY CLAIM

The present application claims priority to U.S. Provisional Application No. 63/171,325, entitled "A Mat System," filed on Apr. 6, 2021; the contents of which are hereby incorporated by reference in their entirety.

SUMMARY

Disclosed is a mat system. The mat system may include a plurality of mats. Each of the plurality of mats may include a first surface, a second surface, and a curved surface. The first surface may include a first connector and the second surface may include a second connector. The curved surface may extend from the first surface to the second surface. Upon assembly of the mat system, the first and second connectors of a mat may engage connectors of a first and second adjacent mats. The curved surfaces of the plurality of mats may form a void in a center region of the mat system.

BRIEF DESCRIPTION OF THE FIGURES

In the drawings, which are not necessarily drawn to scale, like numerals can describe similar components in different views. Like numerals having different letter suffixes can represent different instances of similar components. The drawings illustrate generally, by way of example, but not by way of limitation, various embodiments discussed in the present document.

Corresponding reference characters indicate corresponding parts throughout the several views. The exemplifications set out herein illustrate exemplary embodiments of the disclosure, and such exemplifications are not to be construed as limiting the scope of the disclosure in any manner.

DETAILED DESCRIPTION

Figure 1:
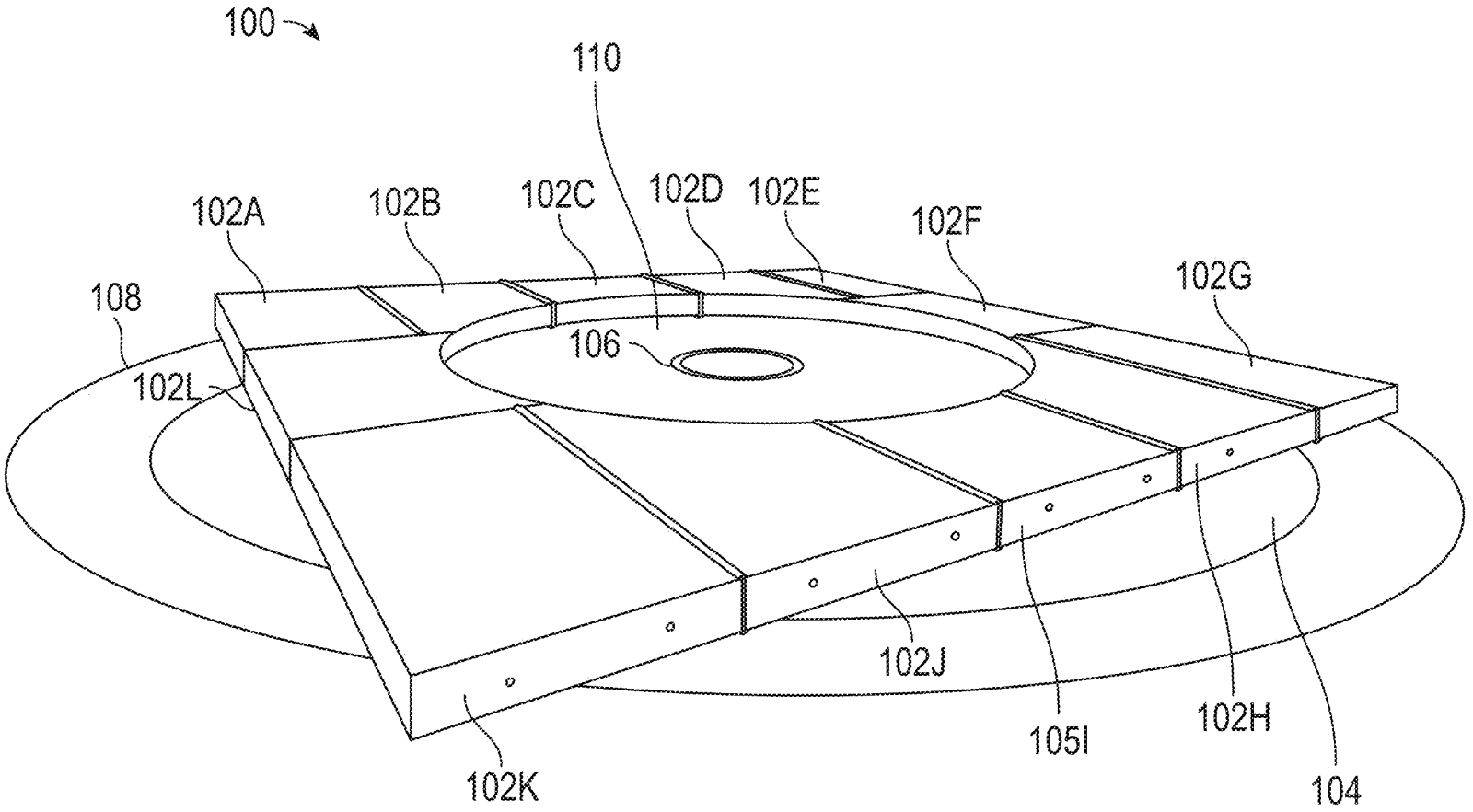
FIG. 1 shows an example mat system consistent with embodiments of this disclosure.

A traditional wrestling mat consists of a continuous surface with a large circle printed on it to represent the wrestling ring. During a wrestling match, the competitors utilize various wrestling moves in an attempt to pin one another or otherwise cause an opponent to submit. This is all done inside the ring outlined on the wrestling mat. During training the technical maneuvers can be performed inside and outside the ring.

The ring may be a standard size (i.e., diameter) depending on the style of wrestling. For example, for Greco Roman wrestling the diameter of the ring may be different than the diameter for freestyle wrestling. The diameter may also vary depending on the age of the competitors. For instance, the diameter for high school athletes may be smaller than the diameter for college athletes.

Disclosed herein is a mat system for use in a training program for wrestling. The mat system may include a plurality of mats. The mats may be connected together and once connected, the mats may define a void. The void may have a circular shape. As part of the training program, wrestlers may practice throws and other techniques inside the circular-shaped void. The void may provide a boundary in which the wrestlers must stay. Should they step outside the void, they may be penalized with a point deduction or disqualification.

As disclosed herein, the training program may begin with athletes learning various wrestling techniques and utilizing weights and other training aids. For example, wrestlers may begin by learning proper motion and mechanics as well as proper hand placement and grips. After learning grips, wrestlers may progress to learning body motions and/or mechanics by moving appropriate weights, such as Bulgarian Bags, Suples Balls, wrestling dummies, as well as elastic bands, through a range of motions to improve specific throwing techniques. The range of motions may start small and progress to wider ranges of motion as the wrestlers learn proper techniques.

From weights, the training program may progress to weighted dummies. The dummies may closely resemble the human form. Using the dummies, the wrestlers may work on their grips and positioning their bodies to throw an opponent. For example, using a dummy, a wrestler may practice gripping an arm or other body part of the dummy. Once the grip is learned, the wrestler may throw the dummy to practice throwing techniques. The work with dummies may take place inside the void of the mat system disclosed herein.

After practicing throws and other techniques with dummies, the wrestlers may spar with one another inside the void of the mat system disclosed herein. As disclosed herein, the diameter of the void may be smaller than that of an official wrestling ring. The smaller diameter will force the wrestlers to engage one another in close quarters. The result is that instead of avoiding one another, the wrestlers will be forced to engage one another and practice the various throws and techniques that were learned and practiced using the dummies. Thus, the wrestlers will learn how to be more offensive, but at the same time they will be forced to learn how to perform counter attacks if they allow the opponent to initiate technical action first. A benefit here is that both athletes will have the opportunity to learn something from each technical action performed by his or her opponent.

FIG. 1 shows a mat system 100 consistent with embodiments of this disclosure. As shown in FIG. 1, mat system 100 may include a plurality of mats 102 (labeled individually as mat 102A, 102B, 102C, . . . 102L). In an example, a first mat 102A has a first profile, a second mat, 102B has a second profile and a third mat 102C has a third profile. Optionally, the first profile, the second profile and the third profile can be different from each other. The first mat 102A, for example, can include at least one perimeter surface, as illustrated in FIG.1, that establishes an outer portion of the mat system 100. In an example, the perimeter surface can extend along at least one side of the perimeter of each of the plurality of mats 102. The perimeter surface can include a thickness of each of the plurality of mats 102, as described further related to FIG. 2. The perimeter surface can extend between a top surface of each mat of the plurality of mats 102 and a bottom surface of each mat of the plurality of mats. Optionally, a connecting surface, as described related to FIG. 3, can be arranged along a side portion of at least one of the plurality of mats opposed to the perimeter surface. The connecting surface, as illustrated in FIG. 3 can extend between the top surface and the bottom surface. When assembled, plurality of mats 102 may be located upon a wrestling mat 104. Wrestling mat 104 may include a surface printing of a first ring 106 and a second ring 108. As shown in FIG. 1, plurality of mats 102 may have a thickness and may define a void 110.

Void 110 may have any number of shapes. For example, as shown in FIG. 1, void 110 may have a circular shape. Other shapes include, but are not limited to, squares, rectangles, ovals, etc. Void 110 may be used to restrict the movement of wrestlers, or other athletes, as part of training exercises as disclosed herein.

Figure 2:
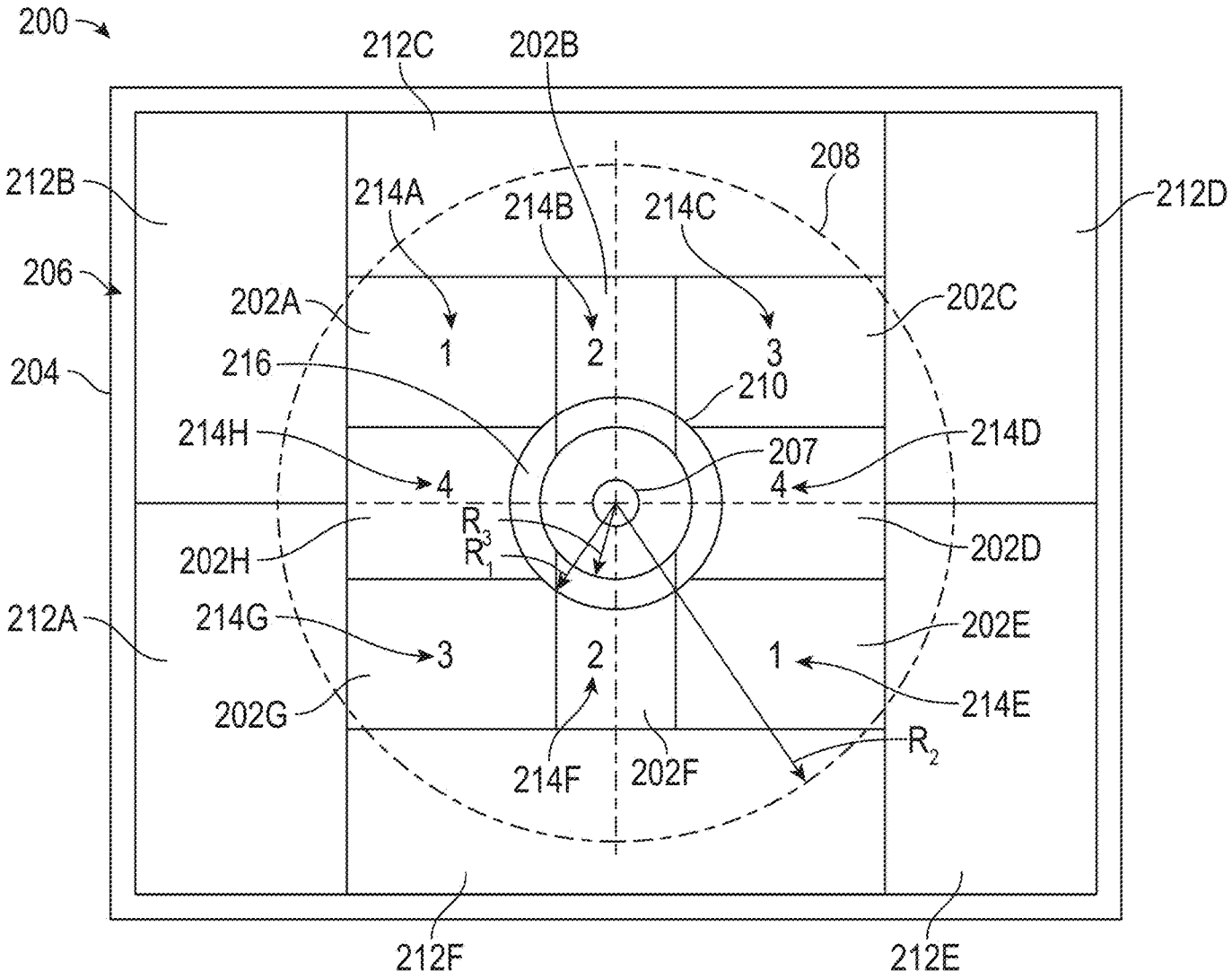
FIG. 2 shows an example mat system consistent with embodiments of this disclosure.
Figure 3:
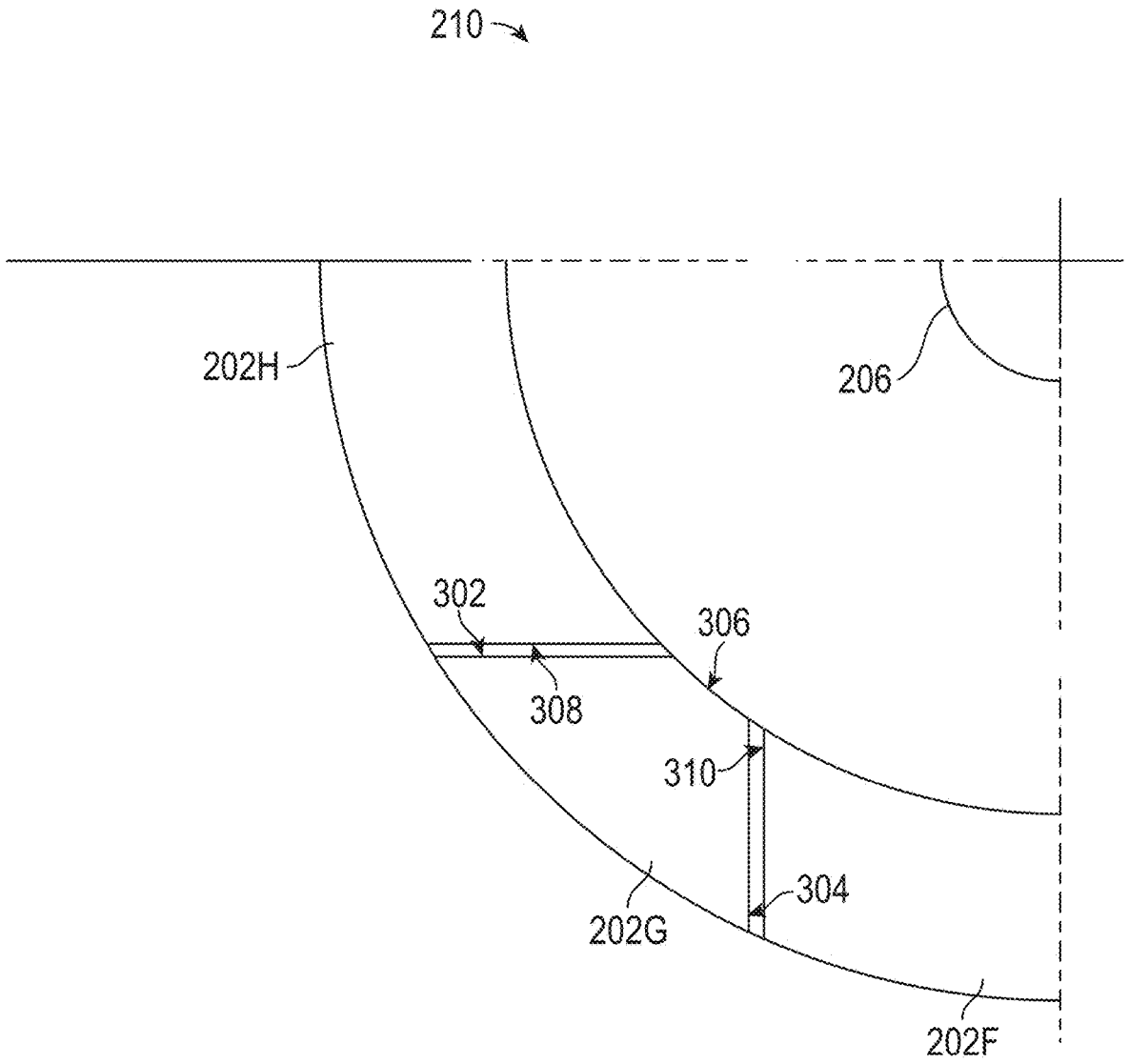
FIG. 3 shows a detail of a portion of a void consistent with embodiments of this disclosure.

FIG. 2 shows a plan view of a mat system 200 consistent with embodiments of this disclosure. As shown in FIG. 2, mat system 200 may include a plurality of mats 202 (labeled individually as mat 202A, 202B, 202C, . . . 202H). When assembled, plurality of mats 202 may be located upon a wrestling mat 204. Wrestling mat 204 may include a surface printing of a first ring 207 and a second ring 208. As shown in FIG. 2, plurality of mats 202 may a void 210. Even though mat 204 is described as a wrestling mat, the disclosure is not limited in this regard and a different type of mat may be used as well (e.g., a judo mat, or tatami, or a mat used in connection with a different sport). Additionally, surface printings associated with reference numbers 214 and 208 may be of different shapes, such as squares, rectangles, etc.

Void 210 may have any number of shapes. For example, as shown in FIG. 2, void 210 may have a circular shape. Other shapes include, but are not limited to, squares, rectangles, ovals, etc. Void 210 may be used to restrict the movement of wrestlers, or other athletes, as part of training exercises as disclosed herein.

Mat system 200 may also include a second plurality of mats 212 (labeled individually as mat 212A, 212B, . . . 212F. Second plurality of mats 212 may be the same or different thickness than plurality of mats 202. Second plurality of mats 212 may provide additional cushion and/or safety should athletes fall or otherwise be thrown beyond an area covered by plurality of mats 202. Each of plurality of mats 212 may have the same shape and/or size as each other or each of plurality of mats 212 may have different sizes and/or shapes.

Plurality of mats 202 may have one or more subsections of mats that have the same size and/or shapes. For example, mat 202A and mat 202E may have the same shape and size. Mat 202C and mat 202G may have the same shape and size. Mats 202B and 202F may have the same size and shape. Mats 202D and 202H may have the same size.

As shown in FIG. 2, plurality of mats 202 can define void 210. Void 210 can have a radius of $R_1$. Ring 208 may have a radius of $R_2$, which may be a regulation-sized ring used in wrestling. $R_1$ may be less than $R_2$. The smaller radius may create a more confined space in which athletes, such as wrestlers or judo athletes, can train. By creating the more confined space, the athletes are forced to be more aggressive and engage one another due to a reduction in the area upon which they can move. Stated another way, because the athletes are forced into closer proximity to one another, they are forced to engage each other instead of evading each other.

The diameter of void 210, sometimes referred to as a combat area, may vary based on the age of the wrestlers. The diameter may also vary on the style of wrestling that the wrestlers are practicing. Other factors that may affect the diameter may be the wishes of a coach and a style and/or training regimen the wrestlers are following.

As part of the training program, if an athlete steps outside of void 210, such as upon a top surface of any of plurality of mats 202, the athlete may be assessed a penalty. For example, a single foot stepping outside of void 210 may result in a one-point penalty. Two feet stepping outside of void 210 or excessively stepping one foot outside of void 210 may result in disqualification.

The size and/or shape of void 210 may be adjustable using an insert 216. For example, as shown in FIG. 2, insert 216 may result in void 210 having a radius $R_3$, which is less than $R_1$. Insert 216 can be a single piece of mat material or may be constructed of a plurality of segments as illustrated in FIG. 2. The use of insert 216 can allow the size and shape of void 210 to be altered for different training exercises as well as different size and/or experience levels of the athletes. For example, for younger, and hence smaller athletes, insert 216 can be used to create a void with a smaller radius. For more skilled athletes, a smaller radius may require improved techniques due to a limited space in which to perform maneuvers.

To aid in assembling mat system 200, each mat of plurality of mats 202 may have reference labels 214 (labeled individually as reference label 214A, 214B, . . . 214H). Each of reference labels 214 may be unique or various reference labels 214 may be the same as shown in FIG. 2. For example, each of reference labels 214 may be unique, such as numbers 1, 2, 3, . . . 8, to correspond to each mat. During assembly of mat system 200 the numbers can be used or orient and place plurality of mats 202 in the proper position and/or orientation. As shown in FIG. 2, mats that have the same size and shape can have the same reference label. For instance, since mats 202A and 202E have the same size and shape, reference labels 214A and 214E can be the same reference label. In some aspects, the reference labels 214 may be placed on a side or a bottom surface of plurality of mats 202 so that reference labels 214 are not visible when plurality of mats 202 are arranged and form the void 210.

FIG. 3 shows a detail of a portion of void 210 consistent with embodiments of this disclosure. As shown in FIG. 3, each mat of plurality of mats 202, such as mat 202G, may include a first surface 302, a second surface 304, and a curved surface 306 that extends from first surface 302 to second surface 304. Upon assembly of mat system 200, the curved surfaces 306 of each of plurality of mats 202 defines void 210 in a center region of mat system 200.

During assembly of mat system 200, first surface 302 and second surface 304, which may include connectors as disclosed herein, may contact first and second surfaces of adjacent mats. For example, as shown in FIG. 3, first surface 302 of mat 202G may engage a first surface 308 of mat 202H and second surface 304 of mat 202G may engage a second surface 310 of mat 202F. Note the spacing between mats 202F, 202G, and 202H is exaggerated in FIG. 3 for clarity.

Figure 4:
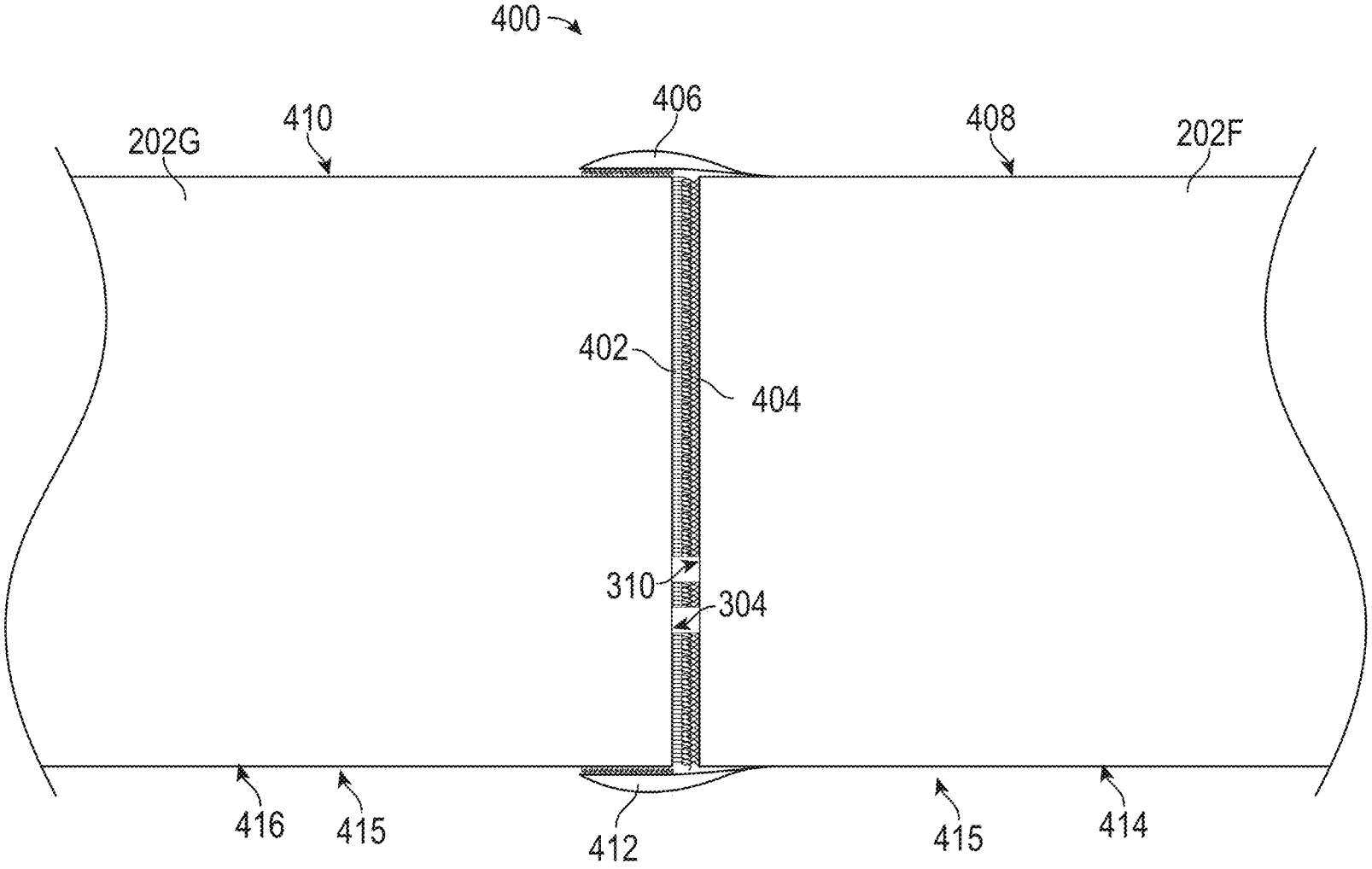
FIG. 4 shows a joint between two mats consistent with embodiments of this disclosure.

FIG. 4 shows a joint 400 between two mats consistent with embodiments of this disclosure. For example, joint 400 shown in FIG. 4 may be the joint between mats 202F and 202G. As shown in FIG. 4, first surface 302 may include a first connector 402 and second surface 310 may include a second connector 404. Examples of connectors 402 and 404 include a hook and loop connector commonly referred to as Velcro®. During assembly of mat system 200, plurality of mats 202 can be brought into contact with one another and connectors can join plurality of mats 202 to form void 210.

Each mat of plurality of mats 202 may include a flap that can cover joints, such as joint 400. For example, and as shown in FIG. 4, a first flap 406 may extend from a top surface 408 of mat 202F across joint 400 and engage a top surface 410 of mat 202G. A second flap 412 may extend from a bottom surface 414 of mat 202F and engage a bottom surface 416 of mat 202G. While FIG. 4 shows first and second flaps 406 and 412 extending from mat 202F, each mat may have a respective flap. For example, first flap 406 may extend from mat 202F to engage mat 202G and second flap 412 may extend from mat 202G to engage mat 202F.

To engage an adjacent mat, first and second flaps 406 and 412 may each have a connector that engages a corresponding connector of the adjacent mat. For example, first and second flaps 406 and 412 may each include a first component of a hook and loop fastener and mats 202F and 202G may have a second component of the hook and loop fastener to allow first and second flaps 406 and 412 to engage adjacent mats.

Bottom surfaces 414 and 416 may include a non-slip coating, as an example of an anchor 415. The non-slip coating 415 may allow mat system 200 to rest on wrestling surface 206 without moving as athletes train. Bottom surfaces 414 and 416 also may include strips or patches of hook and loop fasteners and/or a non-slip material, such as rubber, that may act to anchor 415 mat system 200 into position.

Figure 5:
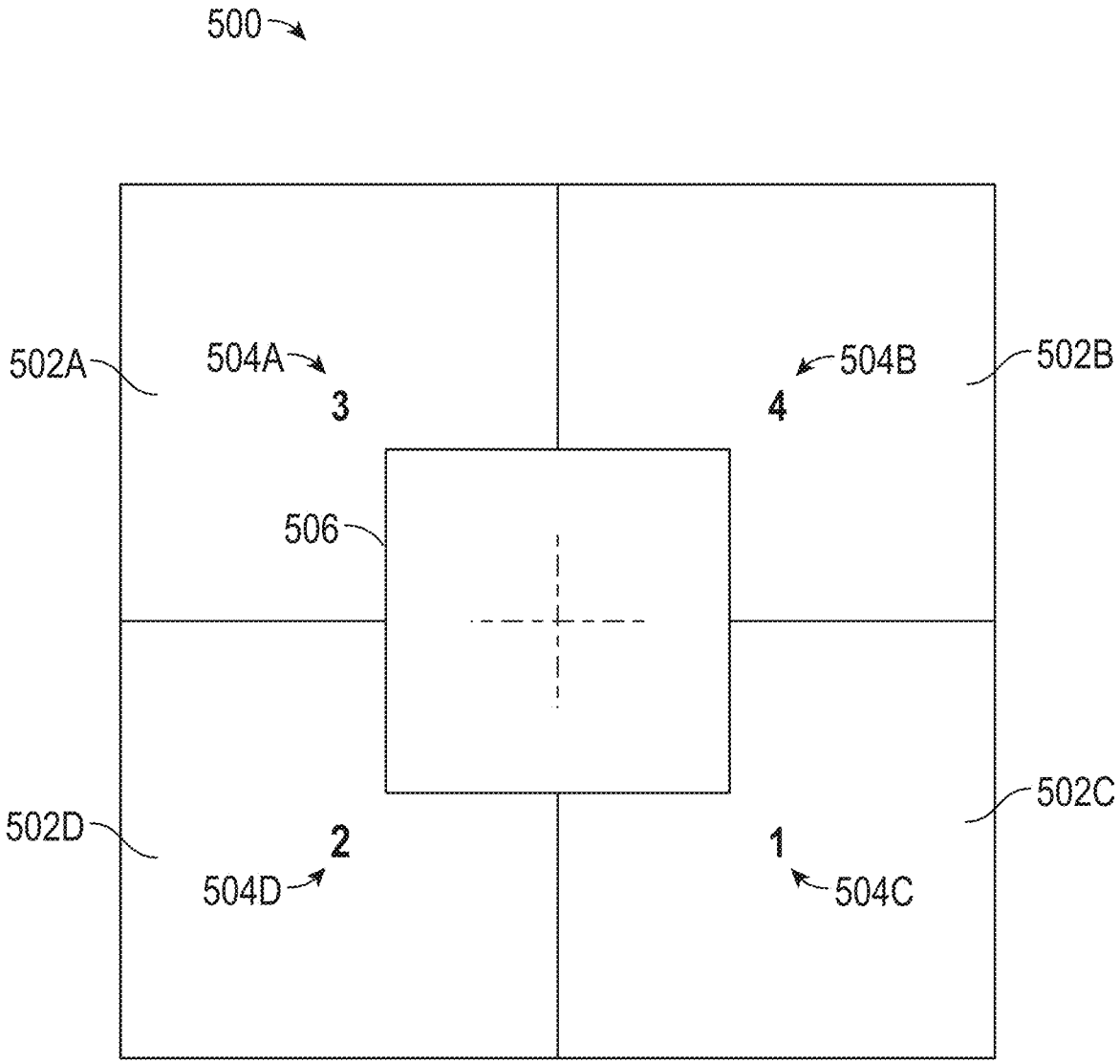
FIG. 5 shows an example mat system consistent with embodiments of this disclosure.

FIG. 5 shows a mat system 500 consistent with embodiments of this disclosure. Mat system 500 may include a plurality of mats 502 (labeled individually as mat 502A, 502B, 502C, and 502D). As shown in FIG. 5, each of plurality of mats 502 can have the same shape and size. Thus, each mat of plurality of mats 202 can are interchangeable with one another. Each mat of plurality of mats 502 can include reference labels 504 (labeled individually as 504A, 504B, 504C, and 504D).

While FIG. 5 shows reference labels 504 having numbers 1-4, reference labels 504 can be the same number. For example, in different mat systems, reference labels 504 can be used to identify the size of a void 506 form by mat system 500. For example, a reference label of "3" may be indicated that void 506 has a radius (in the case void 506 is circular) or a length and width (in the case void 506 is a square) of 3 feet.

EXAMPLES AND NOTES

The following, non-limiting examples, detail certain aspects of the present subject matter to solve the challenges and provide the benefits discussed herein, among others.

Example 1 is a mat system comprising: a plurality of mats, each of the mats including: a first surface including a first connector, a second surface including a second connector, and a curved surface extending from the first surface to the second surface, wherein upon assembly of the mat system, the first and second connectors of a mat engage connectors of a first and second adjacent mats, and the curved surfaces of the plurality of mats form a void in a center region of the mat system.

In Example 2, the subject matter of Example 1 optionally includes wherein the void has a circular shape.

In Example 3, the subject matter of any one or more of Examples 1-2 optionally include wherein each of the plurality of mats includes a first flap located proximate the first connector, wherein upon assembly of the mat system, the first flap engages the first adjacent mat.

In Example 4, the subject matter of any one or more of Examples 1-3 optionally include wherein a subset of the plurality of mats includes a first flap located proximate the first connector, wherein upon assembly of the mat system, the first flap engages the first adjacent mat.

In Example 5, the subject matter of Example 4 optionally includes wherein the subset of the plurality of mats includes a second flap located proximate the second connector, wherein upon assembly of the mat system, the second flap engages the second adjacent mat.

In Example 6, the subject matter of any one or more of Examples 1-5 optionally include wherein each of the plurality of mats includes a reference label.

In Example 7, the subject matter of any one or more of Examples 1-6 optionally include wherein a subset of the plurality of mats includes a non-slip coating applied to a floor contact surface.

In Example 8, the subject matter of any one or more of Examples 1-7 optionally include an insert that, upon assembly of the mat system, reduces a size of the void in the center region of the mat system.

In Example 9, the subject matter of any one or more of Examples 1-8 optionally include wherein the first and second connectors are hook and loop fasteners.

In Example 10, the subject matter of any one or more of Examples 1-9 optionally include wherein the mat system is a component of a wrestling training system.

Example 11 is a mat system comprising: a first mat including: a first surface including a first connector, a second surface arranged normal to the first surface, and a first curved surface extending from the first surface to the second surface; and a second mat including: a third surface including a second connector, a fourth surface arranged normal to the third surface, and a second curved surface extending from the third surface to the fourth surface, wherein upon assembly of the first and second mats, the first connector engages the second connector, and the first curved surface and the second curved surface form a continuous curved portion of a void in a center region of the mat system.

In Example 12, the subject matter of Example 11 optionally includes wherein the continuous curved portion of the void has a circular shape.

In Example 13, the subject matter of any one or more of Examples 11-12 optionally include wherein the first mat includes a first flap located proximate the first connector, wherein upon assembly of the mat system, the first flap engages a top surface of the second mat.

In Example 14, the subject matter of Example 13 optionally includes wherein the second mat includes a second flap located proximate a third connector, wherein upon assembly of the mat system, the second flap engages and adjacent mat.

In Example 15, the subject matter of any one or more of Examples 11-14 optionally include wherein each of the first and second mats includes a reference label.

In Example 16, the subject matter of any one or more of Examples 11-15 optionally include wherein at least one of the first and second mats includes a non-slip coating applied to a floor contact surface.

In Example 17, the subject matter of any one or more of Examples 11-16 optionally include wherein the first and second connectors are hook and loop fasteners.

In Example 18, the subject matter of any one or more of Examples 11-17 optionally include an insert that, upon assembly of the mat system, reduces a size of the void in the center region of the mat system.

In Example 19, the subject matter of any one or more of Examples 11-18 optionally include wherein the first and second connectors are hook and loop fasteners.

In Example 20, the subject matter of any one or more of Examples 11-19 optionally include wherein the mat system is a component of a wrestling training system.

Example 21 is a mat system comprising: a first plurality of mats, each of the mats including: a first surface including a first connector, a second surface including a second connector, and a curved surface extending from the first surface to the second surface; and a second plurality of mats, each of the mats including: a first surface including a first connector, a second surface including a second connector, and a curved surface extending from the first surface to the second surface; and wherein upon assembly of the first plurality of mats, the first and second connectors of a mat of the first plurality of mats engage connectors of a first and second adjacent mats of the first plurality of mats, and the curved surfaces of the first plurality of mats form a first void in a first center region of the first plurality of mats, the first void having a first size, wherein upon assembly of the second plurality of mats, the first and second connectors of a mat of the second plurality of mats engage connectors of a first and second adjacent mats of the second plurality of mats, and the curved surfaces of the second plurality of mats form a second void in a second center region of the first plurality of mats, the second void having a second size, wherein the first size is larger than the second size.

In Example 22, the subject matter of Example 21 optionally includes wherein the first and second voids are circular shapes with different radii.

In Example 23, the subject matter of any one or more of Examples 21-22 optionally include wherein each of the first plurality of mats includes a first flap located proximate the first connector, wherein upon assembly of the first plurality of mats, the first flap engages the first adjacent mat of the first plurality of mats.

In Example 24, the subject matter of any one or more of Examples 21-23 optionally include wherein a subset of the first plurality of mats includes a first flap located proximate the first connector, wherein upon assembly of the first plurality of mats, the first flap engages the first adjacent mat of the first plurality of mats.

In Example 25, the subject matter of Example 24 optionally includes wherein the subset of the first plurality of mats includes a second flap located proximate the second connector, wherein upon assembly of the first plurality of mats, the second flap engages the second adjacent mat.

In Example 26, the subject matter of any one or more of Examples 21-25 optionally include wherein each of the first plurality of mats includes a reference label.

In Example 27, the subject matter of Example 26 optionally includes wherein each of the second plurality of mats includes a reference label.

In Example 28, the subject matter of any one or more of Examples 21-27 optionally include wherein a subset of the first plurality of mats includes a non-slip coating applied to a floor contact surface.

In Example 29, the subject matter of Example 28 optionally includes wherein a subset of the second plurality of mats includes a non-slip coating applied to a floor contact surface.

In Example 30, the subject matter of any one or more of Examples 21-29 optionally include a first insert that, upon assembly of the first plurality of mats, reduces a size of the first void in the first center region of the first plurality of mats.

In Example 31, the subject matter of Example 30 optionally includes a second insert that, upon assembly of the second plurality of mats, reduces a size of the second void in the second center region of the second plurality of mats.

In Example 32, the subject matter of any one or more of Examples 21-31 optionally include wherein the first and second connectors of the first plurality of mats and the second plurality of mats are hook and loop fasteners.

In Example 33, the subject matter of any one or more of Examples 21-32 optionally include wherein the mat system is a component of a wrestling training system.

In Example 34, the systems of any one or any combination of Examples 1-33 can optionally be configured such that all elements or options recited are available to use or select from.

The above-detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof) or with respect to other examples (or one or more aspects thereof) shown or described herein.

In the event of inconsistent usages between this document and any documents so incorporated by reference, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels and are not intended to impose numerical requirements on their objects.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. § 1.72(b), to allow the reader to quickly ascertain the nature of the technical disclosure. It is submitted with the understanding that it will not be used to interpret or limit the scope or meaning of the claims. Also, in the above Detailed Description, various features may be grouped to streamline the disclosure. This should not be interpreted as intending that an unclaimed disclosed feature is essential to any claim. Rather, the inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined in various combinations or permutations. The scope of the invention should be determined with reference to the appended claims, along with the full scope of equivalents to which such claims are entitled.

What is claimed is:

1. A mat system comprising:

a plurality of mats including:

one or more first mats having a first profile with at least one first perimeter surface extending between a first top surface and a first bottom surface, the at least one first perimeter surface forms a portion of a perimeter of the mat system, and a connecting surface opposed to the at least one first perimeter surface extending between the first top surface and the first bottom surface;

wherein the first bottom surface engages with at least one of a floor surface or a second mat system;

one or more second mats having a second profile different from the one or more first mats, and one or more third mats having a third profile different from the one or more first mats and the one or more second mats;

wherein each of the one or more second mats and the one or more third mats includes:

a top surface and a bottom surface;

a first surface extending between the top surface and the bottom surface including a first connector extending along the first surface; and a second surface extending between the top surface and the bottom surface including a second connector extending along the second surface; and a curved surface extending from the first surface to the second surface, of each of the one or more second mats and the one or more third mats;

wherein upon assembly of the mat system, the connecting surface of the one or more first mats is configured to engage with one of the first connector of the one or more second mats, and the second surface of the one or more second mats is configured to engage with the first surface of the one or more third mats;

wherein the curved surface of the at least one of the one or more second mats and at least one of the one or more third mats form a continuous curved portion of a void in a center region of the mat system;

wherein upon assembly of the mat system, the plurality of mats forms a wrestling mat system.

2. The mat system of claim 1, wherein a subset of mats of the one or more first mats includes a first flap located proximate the connecting surface, wherein upon assembly of the mat system, the first flap engages an adjacent mat.

3. The mat system of claim 2, wherein the subset of mats of the one or more first mats includes a second flap located on the bottom surface proximate to the connecting surface, wherein upon assembly of the mat system, the second flap engages the adjacent mat.

4. The mat system of claim 1, wherein at least one mat of the plurality of mats includes one or more anchors;

wherein at least one anchor of the one or more anchors includes a non-slip coating.

5. The mat system of claim 4, wherein at least one of the one or more anchors includes at least one of a strip or patch of one or more of a hook and loop fastener or a non-slip material.

6. The mat system of claim 1, wherein the void has a circular shape.

7. The mat system of claim 1, wherein each mat of the one or more first mats includes a first flap located proximate the connecting surface, wherein upon assembly of the mat system, the first flap engages an adjacent mat.

8. The mat system of claim 1, wherein the first connector and the second connector are hook and loop fasteners.

9. The mat system of claim 1, wherein the mat system is a component of a wrestling training system.

10. A mat system comprising:

a first mat having a first profile, the first mat including:

a top surface and a bottom surface;

a first outer perimeter surface extending between the top surface and the bottom surface;

a second outer perimeter surface extending angularly from the first outer perimeter surface;

a first connecting surface extending between the top surface and the bottom surface and the first connecting surface extending at an angle relative to the first outer perimeter, the first connecting surface including a first connector extending along the first connecting surface;

a second connecting surface extending between the top surface and the bottom surface and the second connecting surface extending at an angle from the second outer perimeter surface, the second connecting surface including a second connector extending along the second connecting surface; and a second mat having a second profile different from the first mat, the second mat including:

a top surface and a bottom surface;

a third surface extending between the top surface and the bottom surface including a third connector positioned along the third surface;

a fourth surface opposite the third surface, the fourth surface including a fourth connector; and a curved surface extending from the third surface to the fourth surface;

wherein upon assembly of the first mat and the second mat, the first connector engages the third connector.

11. The mat system of claim 10, wherein the curved surface is a segment of a void having a circular shape.

12. The mat system of claim 10, wherein the first mat includes one or more first anchors and the second mat includes one or more second anchors;

wherein at least one of the one or more first anchors or the one or more second anchors includes a non-slip coating applied to a floor contact surface.

13. The mat system of claim 10, wherein the mat system is a component of a wrestling training system.

* * * * *